United States Patent [19]

Johnson

[11] 4,176,709

[45] Dec. 4, 1979

[54] STACK-TYPE HEAT EXCHANGER

[76] Inventor: Willard L. Johnson, 12923 Lincoln Ave., Huntington Woods, Mich. 48070

[21] Appl. No.: 875,380

[22] Filed: Feb. 6, 1978

[51] Int. Cl.[2] ..... F28F 7/00

[52] U.S. Cl. ..... 165/99; 165/122; 165/DIG. 2; 237/55

[58] Field of Search ..... 165/DIG. 2, 103, 121, 165/122, 154, 128, 54, 97-99, 122; 237/55; 122/DIG. 1; 98/101; 235/55

[56] References Cited

U.S. PATENT DOCUMENTS

| | | | |
|---|---|---|---|
| 908,200 | 12/1908 | Brown | 165/128 |
| 1,790,764 | 2/1931 | Pfeiffer | 165/103 |
| 2,640,412 | 6/1953 | Sweger | 98/101 X |
| 2,882,023 | 4/1959 | Rizzo | 165/121 X |
| 3,522,841 | 8/1970 | Paplexiou | 165/103 |

*Primary Examiner*—Carroll B. Dority, Jr.
*Assistant Examiner*—Theophil W. Streule, Jr.
*Attorney, Agent, or Firm*—Benjamin W. Colman

[57] ABSTRACT

A stack-type heat exchanger having a complementary fan section in attached communication with a heat exchanger tube section, the fan section forcing incoming air through heat exchanger tubes having a damper plate at or adjacent their output ends to generate a positive air pressure in the tubes at a value above and in excess of the pressure of vented stack gases passing through the heat exchanger tube section chamber from and to lower and upper portions of said stack.

10 Claims, 6 Drawing Figures

STACK-TYPE HEAT EXCHANGER

BRIEF SUMMARY OF THE INVENTION

The invention pertains to a stack type heat exchanger disposed in a gas venting stack into which combustion and/or noxious gases are discharged for exhaustion to the outer atmosphere. The heat exchanger is disposed in a portion of the stack between the source of heated vented gases and the roof area, in an exemplary embodiment of the invention. The heat exchanger is so connected to and communicates with the stack that the heated vented gases pass through the heat exchanger to the discharge or exhaust portion of the stack.

The heat exchanger of this invention generally comprises a housing having a plurality of incoming clean air tubes disposed transversely of the direction of flow of the vented gases, the tubes being secured between end plates which form a chamber with the housing side walls for a vented gas passageway. The open air input ends of these tubes are unrestricted, so that a full flow of air from a fan section, connected to and drawing air through ductwork extending to the outside of a building or to the interior of the building, passes into the heat exchanger tube section. The output ends or ports of the tubes are restricted by a damper plate or member secured at or adjacent the output end of the tubes and limit the free flow of air therethrough, thus generating a positive pressure in the tubes of a value above and in excess of that of the vented gases passing through the heat exchanger section. This positive pressure of air in the tubes prevents ingress or inflow of the vented stack gases should there be a crack or leaking area in the walls of the tubes. The positive tube pressure would, in such case, cause the clean tube air to flow into the heat exchanger chamber, mix with the vented gases, and pass up the exhaust stack to the outdoor atmosphere, instead of allowing the vented gases to enter areas where personnel may be working or living.

It is a principal object of the invention to provide an air heat exchanger in a heated gas venting stack, in which clean incoming air, drawn from outside or inside of a building, is passed through heat exchanger tubes under positive pressure above the pressure of the vented gases in the heat exchange section chamber to prevent any flow of the vented gases into the clean air tubes.

Another object is to provide damper members or plates in the output ports of the heat exchanger tubes to generate the required positive pressure differential in the tubes adequate to prevent flow thereinto of the vented stack gases.

These and various further and more specific features, objects and advantages of the invention will appear from the description given below, taken in connection with the accompanying drawings, illustrating by way of example preferred forms or embodiments of the invention. Reference is here made to the drawings annexed hereto and forming an integral part of this specification.

DETAILED DESCRIPTION

Figure 1:
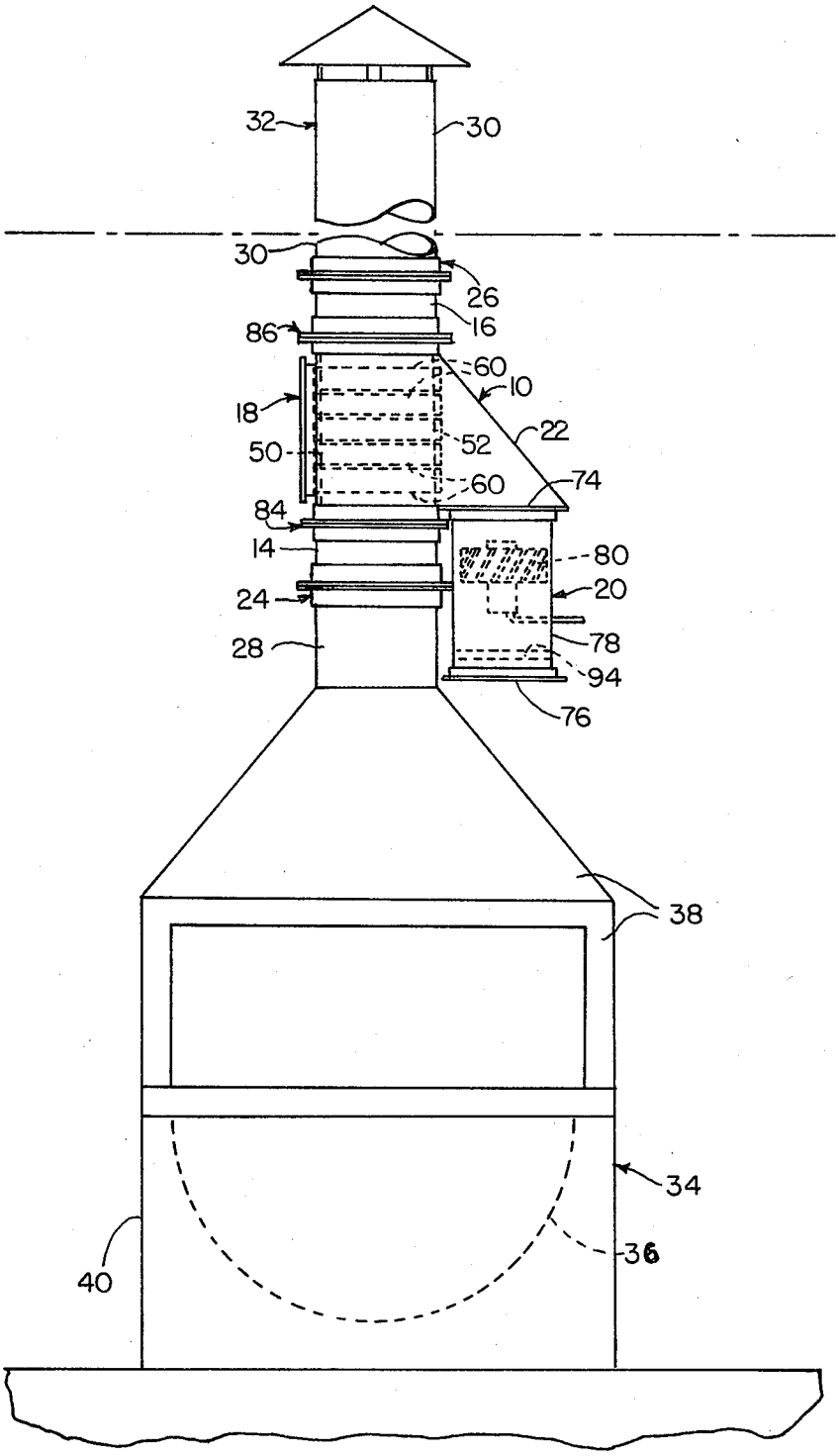
FIG. 1 is a front elevational view of a heating device discharging contaminated gases and fumes to a venting stack, in which an exemplary embodiment of the invention is illustrated.

As illustrated in the several view of the drawings, the heat exchanger device 10 comprises a heat exchanger tube section 12 having a lower transition member 14, an upper transition member 16 and an intermediate tube housing portion 18, a fan section 20 and a fan transition member 22. Each of the tube section transition members 14 and 16 are provided with stack connecting coupling members 24, 26 respectively.

The heat exchanger device 10 is designed for insertion in a gas venting stack and for attachment to and communication with lower and upper portions 28 and 30 respectively of the stack 32. The stack functions as a flue or chimney for exhaustion of combustion and noxious gases emanating from a heat generator 34. As an example, the heat generator may be a conventional metal heating vessel 36, heated by gas or oil flames, or electricity, and treated with fluxing or purifying agents, or other noxious or toxic gases or materials.

A hood 38 is mounted upon the zinc port framing 40 to overly the area in which the combustion and noxious gases are generated and to conduct these gases to the stack 32 with which it is connected and communicates.

The heat exchanger tube housing portion 18 is disposed between the stack sections 28 and 30 and is connected thereto by lower and upper coupling members 24 and 26 respectively, each of which comprises a lower flanged ring 42 attached to the end of the adjacent stack portion and an upper flanged ring 44 attached to the adjacent transition member 14 or 16. The outwardly extending flanges of these rings 42 and 44 are connected together by screws or other suitable fastening means to secure the heat exchanger device 10 to the stack portions 28 and 30.

The intermediate tube housing portion 18 comprises a pair of opposed facing side walls 48, 48 connected at their proximal edges to the fan transition member 22 and at their distal edges to the tube output end plate 50. A tube input end plate 52 is disposed between and connected to the side walls 48, 48 adjacent their proximal edges and the fan transition member 22, to form the heat exchanger chamber 54 and with the output end wall 50. The end plates 50, 52 and side walls 48, 48 form a sealed flue for the vented gases through the tube housing portion 18, between the transition members 14 and 16.

Figure 3:
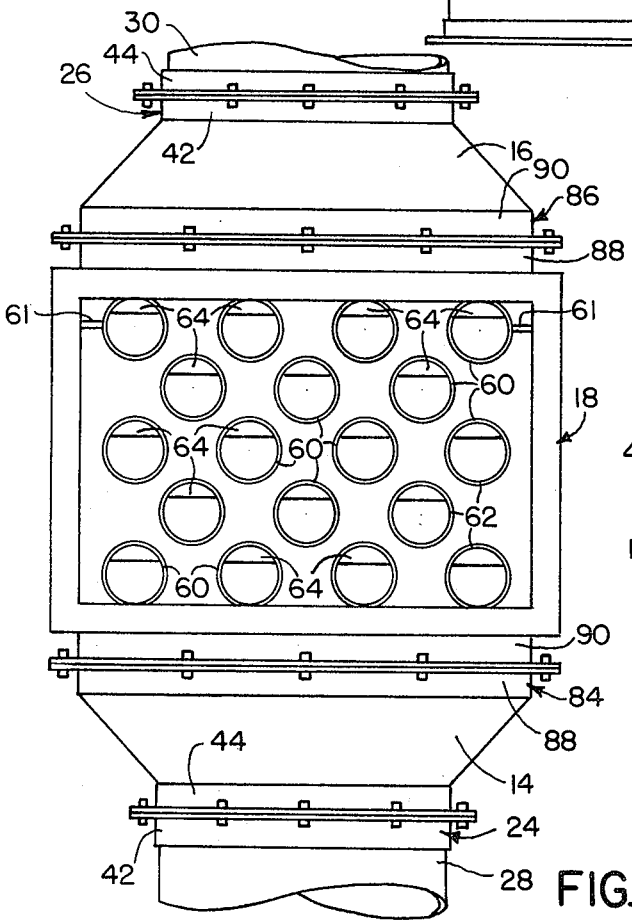
FIG. 3 is a side elevational view of the heat exchanger embodiment taken substantially on the line 3—3 of FIG. 2.

The clean air heat exchanger tubes 60 are disposed in the tube housing portion 18 in a substantially horizontal attitude normal to the direction of flow of the vented stack gases. The tubes are supported by the end plates 50 and 52 and are of such length that they extend beyond the outer surfaces of these plates a short distance. The tubes are welded or otherwise secured to the end plates in gas-tight sealing condition so that the vented stack gases cannot escape into or through the tubes 60 to mix with the incoming clean air which is drawn from either outside or inside of the building in which the heat generator is located. The tubes 60 are arranged in a vertically staggered orientation (FIG. 3) to obtain a more intimate contact with the flow of vented stack gases passing through chamber 54 as they wash across and around the tubes. To assist in this turbulent flow of the gases, a pair of baffle members 61, 61 are disposed in the chamber 54 and secured to the side walls 48, 48 and the upper corner tubes 60 adjacent the side walls, to deflect the flow of gases under and around these tubes. The baffle members 61, 61 extend substantially from input to output end plates 50, 52 respectively.

Figure 4:
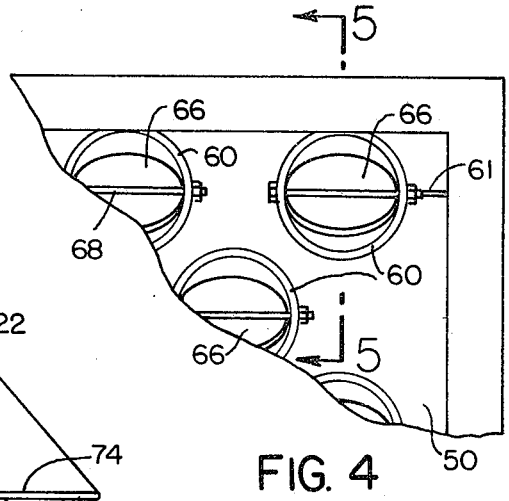
FIG. 4 is a fragmentary enlarged corner portion view, similar to that shown in FIG. 3, illustrating another form of a dampering restriction at the output ends of the heat exchanger tubes.
Figure 5:
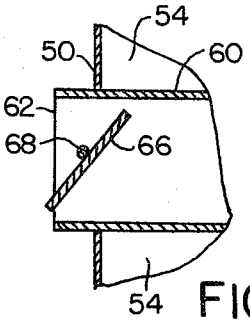
FIG. 5 is a vertical sectional view taken substantially on the line 5—5 of FIG. 4.

The output ends 62 of the tubes 60 are provided with a restriction in the form of a baffle or damper plate 64 which may be fixed in the output port of the tubes (FIG. 3) or a movably adjustable damper 66 (FIGS. 4 and 5). The damper plate 64 comprises a segment of the circle defined by the inner circumference of the cylindrical tube 60. It provides a restriction to the flow of clean heated air through the tube and thus generates a buildup of positive air pressure in the tube. This pressure is in part a function of the area of restriction and the volume of air flow generated by the fan section 20, as well as the temperature of the air in the tubes. The air pressure generated must in all cases be greater than and exceed the static pressure of the vented gases passing from the lower stack portion 28 through chamber 54 to the upper stack portion 30.

The movable adjustable damper plate 66 (FIGS. 4 and 5) is pivotable on the diametric pin 68 disposed between the walls of the tube 60 for adjustment to increase or decrease the amount of restriction to clean air flow through and from the tube. In no case can this damper plate 66 be postured to allow unrestricted air flow from the tube, a condition that will not permit the required build-up of positive air pressure described above.

The heat exchanger transition member 14 and 16 are connected to the tube section 12 by lower and upper coupling members 84, 86 respectively, each of which comprises a lower flanged ring 88 and an upper flanged ring 90 secured together at their flanges by bolts, screws or other suitable fastening means.

The fan section 20 comprises a housing 72 open at its upper and lower ends 74,76 respectively and defined by side walls 78 within which is located and secured a suitable electrically powered motor driven fan unit 80, as for example a vane-type axial fan unit, to draw air, through a duct (not shown) that may extend to the outside of the building or to another location within the building, into the lower opening 76 of the fan section. This input or incoming clean air is forced by the fan unit 80 into and through the transition member 22 and distributed into the heat exchanger tubes 60. The fan section 20 is connected to member 22 by the flanged ring connector 91.

Figure 2:
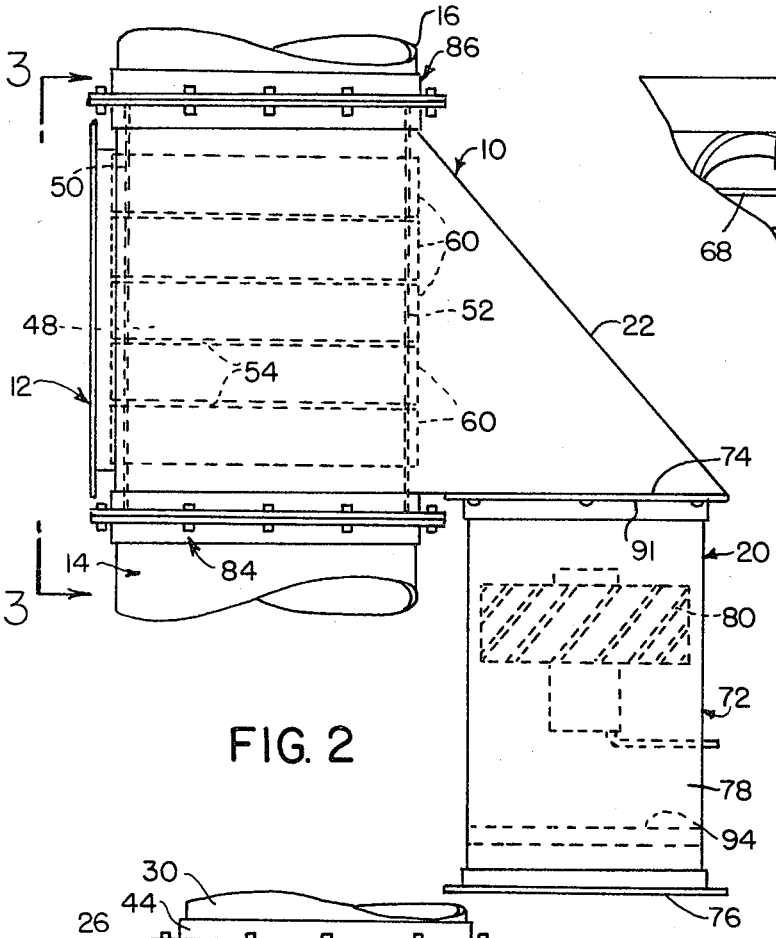
FIG. 2 is an enlarged front elevational view on a somewhat enlarged scale of the heat exchanger embodiment illustrated in FIG. 1.
Figure 6:
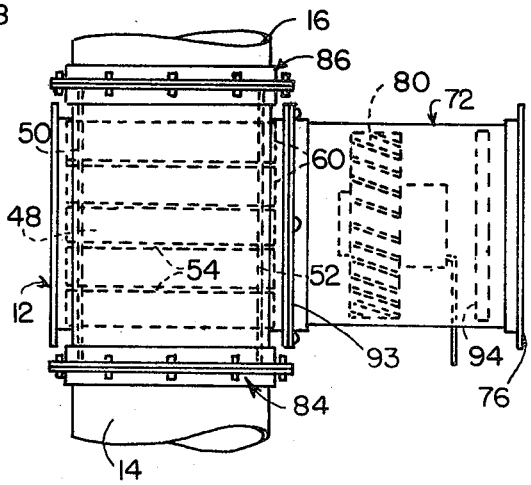
FIG. 6 is a view similar to that shown in FIG. 2, with the fan section coupled directly to the heat exchanger section.

As will be seen in FIGS. 1 and 2, the fan section 20 is suspended from the fan transition member 22 in a cantilever attitude outwardly of the stack 32. In FIG. 6, the fan section 20 is directly connected by a coupling member 93 to the heat exchanger tube portion 18, as an alternate arrangement. Optionally, an air filter 94 may be disposed in the input end 76 of the fan section, to remove some solid particles from the air to be heated. But care must be taken, if an air filter is used, to see that the filter does not become clogged to the extent that air flow is restricted in the fan section sufficient to prevent the required build-up of positive pressure in the tubes 60 in excess of the static pressure of vented stack gases in the heat exchanger chamber 54. Therefore, an air filter must be regularly checked.

It will of course be understood by persons skilled in the art to which the invention pertains that maintenance of a positive pressure in the tubes 60 is essential to prevent the inflow of combustion and/or noxious gases through cracks or openings that may occur in the tubes. The damper plates 64 or 66 will effectively provide such positive air pressure when the fan unit 80 is in operation.

The heat exchanger device 10 is preferably made of steel, and a stainless steel grade 304 is preferably used where noxious chlorine gases are present in the stack 32. Other metals are to be used where normal, special or unusual conditions or systems exist.

A supplementary conduit for heated clean air can be mounted upon and connected to the output end of the tube housing portion 18, to conduct the heated air to specific locations or areas remote from the stack 32. Such conduit is not shown but can be affixed to the device 10.

In operation, the motor driven fan unit 80 is energized to draw clean input air through the fan section 20 and force that air through the distributing fan transition member 22 and the tubes 60 toward the restricting damper plates 64 or 66 at their output ends 62. In view of these damper plates, clean air flow is restricted in the tubes so that air pressure is built-up therein to a measure sufficient to prevent the ingress of combustion and/or noxious gases from the stack portion 28 and chamber 54 into the tubes in the event that they are cracked or porous. The fan unit 80 must also generate an air flow adequate to develop and maintain such a pressure. The vented gases flow across the outer surfaces of the tubes 60 in chamber 54, heating the clean air therewithin and reducing the output stack temperature through heat loss or transfer. The direct connected fan section 20 (FIG. 6) operates in the same manner as above, supplemented if necessary or desirable by an air distributing member in or adjacent the output end 74 of the fan section.

Although particular embodiments of the invention have been disclosed herein for purposes of explanation, further modifications or variations, after study of this specification, will or may become apparent to persons skilled in the art to which the invention pertains. Reference should be had to the appended claims in determining the scope of the invention.

I claim:

1. An improved heat exchanger device disposed in a stack through which heated gases are vented from a heat generating source, the improvement comprising in combination a heat exchanger tube section for the heating and passage therethrough of clean input air, a motor driven fan unit disposed in a fan section connected to and communicating with said tube section, said fan unit drawing said clean input air from a location outside or inside of the building in which said heat generating source is located and forcing said air into and through said tube section, and coupling and transition members conjoining said tube section to and for communication with stack portions thereabove and therebelow, said tube section comprising a housing for and a plurality of spaced apart clean air conducting tubes disposed therein transversely of the flow direction of the vented stack gases, said housing defining a chamber therein for said stack gases to pass therethrough and over and about said tubes therein to heat said tubes and the clean air passing therethrough, said tubes communicating at their input ends with said fan section to receive said clean air therefrom and conducting said air through said tube section housing to the output ends of said tubes for discharge of heated clean air from said tube section, said tubes each having a damper plate attached thereto at its output end to modify and restrict the output orifice of said tube so as to generate a positive air pressure in each of said tubes at a valve above and in excess of the static pressure of said vented stack gases passing through said chamber, whereby to prevent said vented stack gases from entering said clean air conducting tubes.

2. The structure defined in claim 1, and including a fan transition member connected to, communicating with and disposed intermediate said fan section and said tube section housing for distribution of said clean air discharged by said fan unit into said tube section.

3. The structure defined in claim 1, wherein said tube section is disposed between lower and upper coupling and transition members connected to and communicating with lower and upper stack portions respectively.

4. The structure defined in claim 1, wherein said tube section housing is provided with input and output end plates sealingly secured to side walls to define a flow passage therebetween for said vented stack gases, said tubes being secured to said input and output end plates in sealed relationship, end portions of said tubes extending beyond and outward of said end plates.

5. The structure defined in claim 1, wherein said damper plates comprise a baffle member fixedly secured to each said tube at its output end to restrict free flow of heated clean air therethrough and to produce said positive air pressure therein.

6. The structure defined in claim 1, wherein said damper plate comprises a baffle member rotatably secured for adjustment in a fixed position within each said tube at its output end to restrict free flow of heated clean air therethrough and to produce said positive air pressure therein.

7. The structure defined in claim 2, wherein said fan section and said fan section transition member extend outwardly from said tube section housing in a cantilever attitude, said fan section depending from said fan section transition member.

8. The structure defined in claim 1, wherein said fan section is provided with an air filter at or adjacent its input end.

9. The structure defined in claim 1, wherein said fan section is provided with an electrical motor driven fan unit disposed and secured in said section intermediate its input and output ends.

10. The structure defined in claim 1, wherein said tubes are disposed in horizontal rows and vertically spaced apart, parallel, staggered relationship for convoluted flow of said vented stack gases thereabout.

* * * * *